United States Patent [19]

Bauer

[11] Patent Number: 4,680,576

[45] Date of Patent: Jul. 14, 1987

[54] PHOTOELECTRIC SMOKE DETECTOR AND ALARM SYSTEM

[75] Inventor: Frederick T. Bauer, Holland, Mich.

[73] Assignee: Gentex Corporation, Zeeland, Mich.

[21] Appl. No.: 445,083

[22] Filed: Nov. 29, 1982

[51] Int. Cl.[4] ..... G08B 17/10

[52] U.S. Cl. ..... 340/630; 250/573; 250/574; 338/17; 356/338

[58] Field of Search ..... 340/630, 629, 628, 514, 340/636; 250/573, 574, 211 R, 575; 356/435, 438, 439, 337, 338, 341, 343; 357/17; 338/18, 17

[56] References Cited

U.S. PATENT DOCUMENTS

| | | | |
|---|---|---|---|
| 2,407,838 | 9/1946 | Kliever | 250/575 X |
| 2,466,696 | 4/1949 | Friswold et al. | 250/574 X |
| 3,188,593 | 6/1965 | Vasel et al. | 338/18 |
| 3,733,595 | 5/1973 | Benedict | 340/634 X |
| 3,810,696 | 5/1974 | Hutchins, Jr. | 356/435 X |
| 3,922,655 | 11/1975 | Lecuyer | 356/439 X |
| 4,053,785 | 10/1977 | Lee et al. | 340/630 X |
| 4,232,307 | 11/1980 | Marsocci | 340/630 X |
| 4,282,519 | 8/1981 | Haglund et al. | 340/629 X |
| 4,325,058 | 4/1982 | Wagner et al. | 340/636 X |
| 4,333,093 | 6/1982 | Raber et al. | 340/636 X |
| 4,414,558 | 11/1983 | Nishizawa et al. | 357/17 |

*Primary Examiner*—James L. Rowland

*Assistant Examiner*—Daniel Myer

*Attorney, Agent, or Firm*—Malcolm R. McKinnon

[57] ABSTRACT

An improved photoelectric smoke detector and alarm system which may be incorporated in a single station, completely self-contained unitary structure, or which may be incorporated in a multi-station detector system that is capable of self-contained operation but which can also be interconnected with other detectors whereby when any one detector's alarm sounds, all of the other alarms automatically sound in the other interconnected structures, the improved smoke detector and alarm system including a piezoceramic electrically activatable alarm, an illuminating circuit including a gallium aluminum arsenide light emitting diode, and a smoke sensing circuit including a pair of identical photoelectric cells formed on the same substrate with the photoelectric cells mounted in proximity to the light emitting diode whereby light emanating from the light emitting diode impinges upon one of the dual photoelectric cells at all times and impinges upon the other of the dual photoelectric cells to change the conductivity of the other photoelectric cell when particulate matter is present in the ambient atmosphere. An oscillator is included in the circuit which is actuatable in response to a differential in the conductivity of the photocells for actuating the piezoceramic alarm.

4 Claims, 11 Drawing Figures

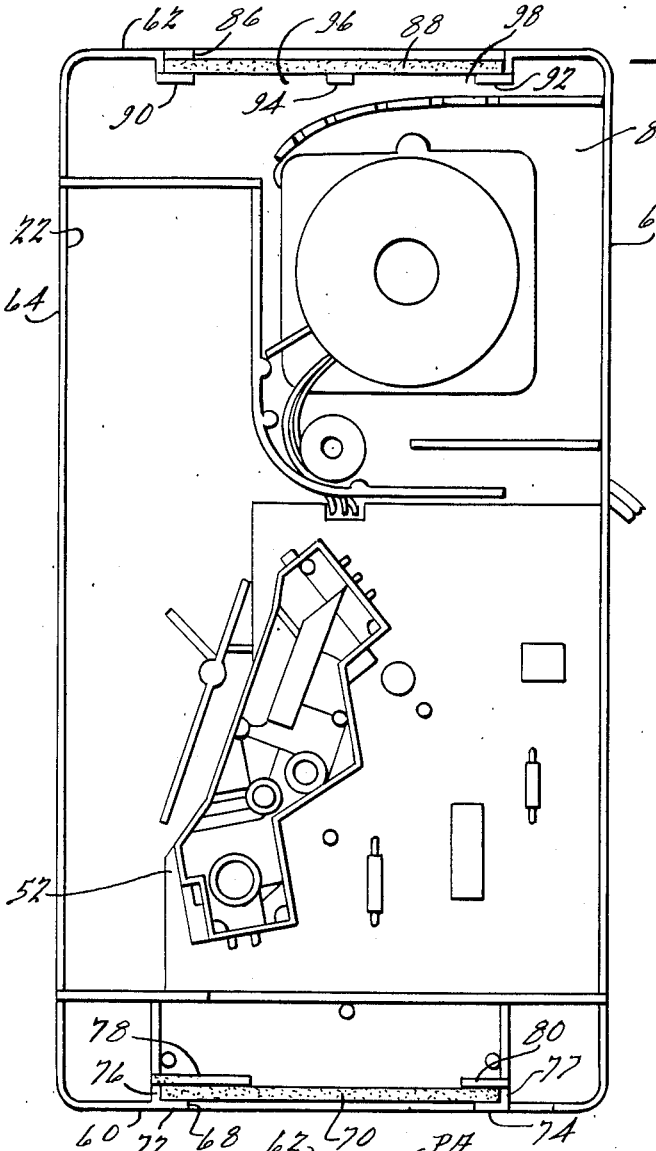
Fig. 6.
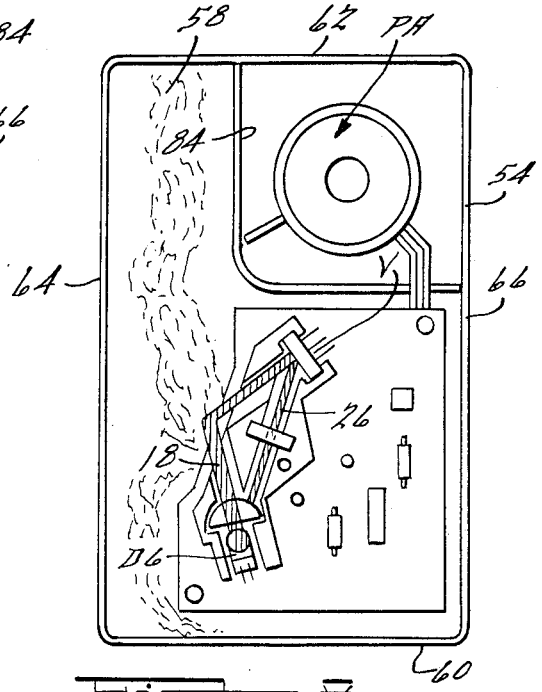
Fig. 8.
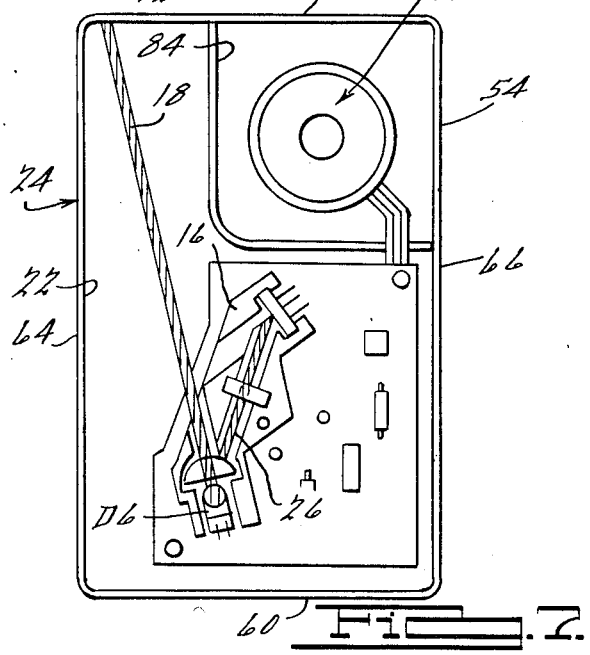
Fig. 7.
Fig. 9.
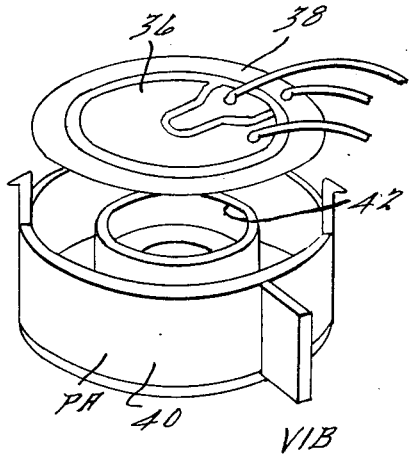
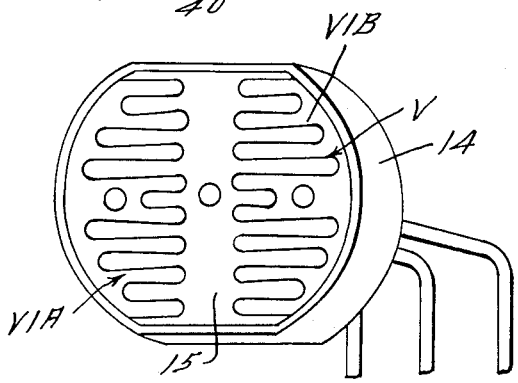
Fig. 10.

PHOTOELECTRIC SMOKE DETECTOR AND ALARM SYSTEM

BRIEF SUMMARY OF THE INVENTION

This invention relates to smoke detectors and, more particularly, to an improved photoelectric smoke detector and alarm system incorporating improved means for detecting airborne particles of smoke of a predetermined density and energizing an alarm for fire warning purposes.

Heretofore, commercially available smoke detectors intended for installatio in new building construction have been of two general types, namely the ionization type and the photoelectric type, each of which type is adapted to be connected to a conventional source of 120 volt, 60 cycle alternating current such as is commonly used in a home or a commercial building. Alternate versions can be connected to a 24 volt, 60 cycle control transformer or a dc supply. Most present day building codes forbid battery powered smoke detectors to be incorporated in new construction. The ionization type smoke detectors and the photoelectric type smoke detectors each have their own particular advantages and problems. Heretofore, the ionization type smoke detectors have been the most commonly used type, the primary advantages of the ionization type smoke detectors being lower cost to manufacture than the photoelectric type, and the ionization type sets off an alarm more rapidly in a fast burning fire. Disadvantages of the ionization type include the fact that the ionization type is nuisance prone and tends to respond to cooking odors, cleaning agents, humidity from showers, and the like, and the ionization type utilizes a radioactive source in its smoke sensing system. Moreover, the ionization type responds slowly to slow burning or smoldering type fires which represent the majority of actual residential fires that cause nighttime injuries and fatalities. Heretofore, the main impediment to the use of photoelectric type smoke detectors has been the fact that photoelectric type smoke detectors tend to cost more to construct than ionization type smoke detectors, much of the cost penalty being due to technological difficulties relating to light emitting diodes and cadmium sulfo-selenide photo conductive light sensors commonly known as photocells.

Most photoelectric tpe smoke detectors use light emitting diodes as the light source rather than incandescent lamps since incandescent lamps tend to burn out relatively rapidly, require low voltage power transformers, and extra circuitry is also required to detect and alert the user of a lamp burn out condition. Light emitting diodes avoid such problems but add a problem of their own in that typically available light emitting diodes emit very little light as compared to incandescent lamps. Most light emitting diodes emit solittle light that the photocells associated therewith are required to perform in an unstable low light region. Photocells are not designed to work at such low levels thereby making supply of adequately stable photocells very difficult due to the many rejects and low manufacturing yields. Photocells also have many inherently difficult parameters which weaknesses are amplified at low light levels. For example, photocells have a "light history effect" meaning that their behavior is governed by the recent history of the light levels that the photocells have "seen". Photocells also have wide ranging temperature coefficient differences in that no two independent cells behave in the same manner, even from the same production batch and cell type. Photocell processing differences cause many of these abnormalities and, unfortunately, are beyond the control of the photocell manufacturers. Heretofore, most commercially available photocell type photoelectric smoke detectors have utilized two separate photocells, one photocell being a light sensing photocell which detects smoke build up to trigger an alarm, while the other photocell is intended to balance out the undesirable aspects of the sensing photocell. Arrangements of this type in electronics are commonly called a "bridge". From a practical standpoint however, the photocell manufacturers are unable to make two separate photocells exactly alike. Two "supposedly" similar photocells often fail to match each other with respect to change of resistance with a given change in light level, or fail to match each other with respect to leakage when the cells are dark, or fail to match each other with respect to speed of response to increased light, light history effect, temperature effect, resistance change with aging, and resistance change with humidity. Consequently, photocell differences occasionally cause detectors to self-alarm with no smoke present when first powered up, when the temperature changes, when the photocells drift with age or when there are other variations such as variations in voltage. As a result, many detectors must be reworked in the manufacturing cycle in an effort to preclude some of these occasional failures. Heretofore, some manufacturers have used another light sensing element commonly known as a photo diode. While the stability increases, the cost of using a photo diode dramatically increases because of the requirement for special infrared light emitting diodes, pulsing techniques to increase the light source, and highly complex electronic circuitry. The photo diode approach is commonly used in battery operated photoelectric type smoke detectors, but the more complex circuits, light sources and light detectors required to maximize energy savings create a very substantial cost penalty.

Another problem with prior photoelectric type smoke detectors hs been that most such prior detectors make use of an electromechanical alarm in the form of a horn having an electromagnetic coil functioning to move a clapper which impinges against a metal disc or plate. Such an arrangement requires the use of many components, and the cost is high. In addition, most prior photoelectric type smoke detectors have utilized a carbon potentionmeter to enable adjustment in production of the smoke sensitivity of each detector. Carbon potentiometers are costly, have a limited range of adjustability and also require special circuitry that further increases complexity as well as cost.

An object of the present invention is to overcome the aforementioned as well as other disadvantages in prior smoke detectors of the indicated character and to provide an improved photoelectric smoke detector and alarm system incorporating improved means for detecting airborne particles of smoke of a predetermined density and activating an alarm for fire warning purposes.

Another object of the present invention is to provide an improved photoelectric smoke detector and alarm system which is far mor stable in operation than prior smoke detectors, which holds calibration better with age, temperature variation, humidity variation and voltage variation, and which enables the quantity and quality production of smoke detectors with a minimum of rejections during the manufacturing process.

Another object of the present invention is to provide an improved smoke detector and alarm system that is simpler in construction and more reliable than prior photoelectric smoke detectors, which may be manufactured, assembled and tested at a minimum of cost, and which is durable and efficient in operation.

Another object of the present invention is to provide an improved photoelectric smoke detector and alarm system which may be incorporated in a single station, completely self-contained unitary structure, or which may be incorporated in a multistation detector system that is capable of self-contained operation, but which can also be interconnected with other detectors into a system wherein any one detector whose alarm sounds automatically causes all of the other alarms to sound everywhere in the system.

Another object of the present invention is to provide an improved photoelectric smoke detector and alarm system incorporating improved means for adjusting and testing the system and which eliminates the necessity of utilizing potentiometers to adjust the smoke sensitivity of each detector.

Still another object of the present invention is to provide an improved photoelectric smoke detector and alarm system which is adapted to be connected to a conventional source of electrical power in a home, office or other building.

The above as well as other objects and advantages of the present invention will become apparent from the following description, the appended claims and the accompanying drawings.

BRIEF DESCRIPTION OF THE DRAWINGS

FIG. 6 is an elevational view of the inside of the base of the housing illustrated in FIG. 3, showing the same with the cover removed therefrom;

FIG. 7 is a schematic view illustrating the light pattern when smoke is not present inside of the housing illustrated in FIG. 3;

FIG. 8 is a schematic view illustrating the light pattern when smoke is present inside the housing illustrated in FIG. 3;

FIG. 9 is an exploded perspective view of the piezo alarm incorporated in the system illustrated in FIG. 1;

FIG. 10 is an enlarged perspective view of the dual photocell incorporated in the system illustrated in FIG. 1.

DETAILED DESCRIPTION

Figure 1:
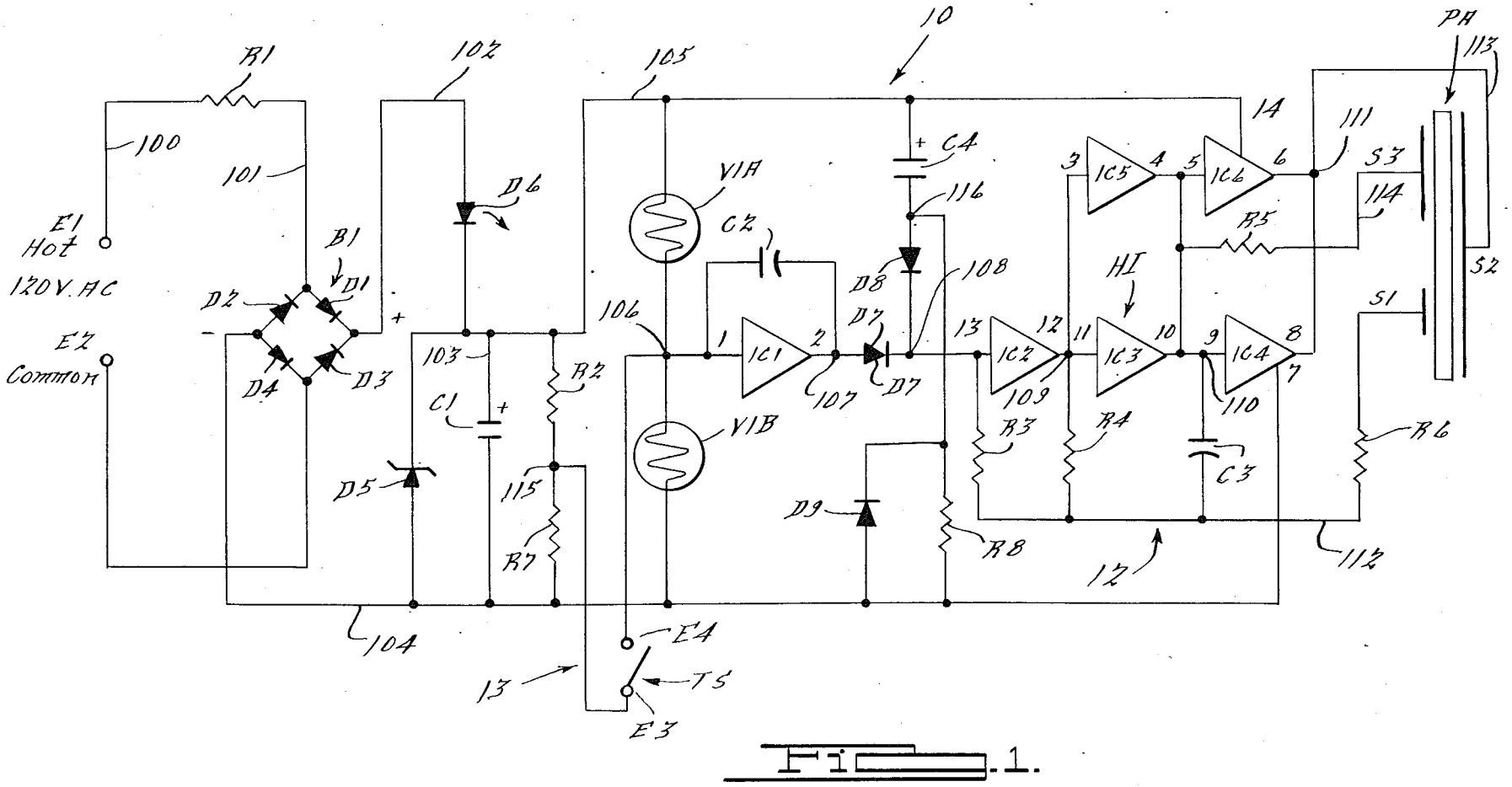
FIG. 1 is a schematic electrical circuit diagram of a smoke detector and alarm system embodying the present invention.

Referring to the drawings, and more particularly to FIG. 1 thereof, the electrical circuitry of a photoelectric smoke detector and alarm system, generally designated 10, embodying the present invention, is schematically illustrated therein. As shown in FIG. 1, the system 10 is provided with electrical terminals E1 and E2 adapted to be connected to a conventional source of 120 volt, 60 cycle alternating current, as for example, a conventional electrical circuit in a home or a commercial building. The system 10 also includes a piezoceramic alarm PA, a full wave bridge, generally designated B1, comprised of diodes D1, D2, D3 and D4, a dual photocell V comprised of two separate cells V1A and V1B on a single substrate, a red gallium aluminum arsenide light emitting diode D6, and a smoke detection, timing and oscillator circuit, generally designated 12, comprising a hex inverter HI which includes six CMOS gates IC1 through IC6. The system 10 also includes a Zener diode D5, capacitors C1, C2, C3 and C4; resistors R1 through R8; and an electronic test circuit, generally designated 13, which includes a test switch TS having normally open contacts E3 and E4, all of the above described components being electrically connected as illustrated in FIG. 1 and as will be described hereinafter in greater detail.

The dual photocell V, which is mounted on a base 14, is a commercially available dual photocell in which one substrate contains the separate cells V1A and V1B on a single surface 15 as shownin FIG. 10. The cells V1A and V1B are manufactured at the same time on the same surface, and any small process change that happens to one half of the dual photocell V will also automatically happen to the other half whereby the cells are processed matched so that their characteristics track each other. For example, the two cells V1A and V1B on the same surface 15 automatically compensate each other for variations due to temperature changes, voltage changes, and age and temperature coefficients thereby increasing the reliability and service life of the system 10.

The light source for the system 10 is provided by the light emitting diode D6 which is preferably a red gallium aluminum arsenide light emitting diode, as distinguished from gallium arsenide phosphide or other light emitting diodes which have been used in prior photoelectric smoke detectors. Light emitted by the light emitting diode D6 is approximately eight times brighter for the same energy input than the light emitted by light emitting diodes utilized in prior photoelectric smoke detectors. The extra light emitted by the light emitting diode D6 enables the dual photocell V to operate in a stable range.

The system 10 incorporates a unique optical sensing head 16 which will be described hereinafter in greater detail, the sensing head 16 functioning, among other things, to split the beam of the light emitted by the light emitting diode D6. In general, the main beam 18 of the light emitted by the light emitting diode D6 passes through a lens 20 and projects into a smoke sensing chamber 22 defined by a housing 24 provided for the system 10 and illustrated in FIGS. 3 through 8. When smoke particles are present in the chamber 22 defined by the housing 24, such smoke particles deflect the main beam of light 18 onto the sensing half V1A of the dual photocell V. A second portion 26 of the beam emitted by the light emitting diode D6 passes into a tunnel or passageway 28 which is open at each end and which communicates with both the light emitting diode D6 and the "compensating half" V1B of the dual photocell V, the tunnel or passageway 28 being defined by the sensing head 16. The portion 26 of the beam emitted by the light emitting diode D6 travels past a light shutter in the form of an adjustable set screw 32 which threadably engages the head 16 and the inner end portion of which may be advanced into and/or retracted from the tunnel 28 so as to vary the amount of light passing completely through the tunnel or passageway 28. The light beam 26 then passes through a filter 34 and impinges on the "compensating half" V1B of the dual photocell V. The "compensating half" V1B of the dual photocell V measures the light emitted by the light emitting diode D6. The above described construction provides a low cost sensitivity adjustment whereby each detector unit can be factory calibrated to the desired percent obscuration per foot smoke density setting.

The piezoceramic alarm PA is comprised of a piezoceramic disc 36 bonded to a thin metal disc 38 which acts as a restraining force on one surface of the piezoceramic disc 36. When an electrical signal of increasing amplitude causes the diameter of the piezoceramic disc 36 to increase, the restraining spring force provided by the metal disc 38 causes the assembly to bend from a flat shape into a convex shape. When the polarity of the electrical signal is reversed, the assembly will bend in the reverse direction into a concave shape. The metal disc will vibrate and produce a sound corresponding to the applied signal, the amplitude of the applied signal determining the amount of the deflection of the assembly and therefore the amplitude of the generated sound wave. The assembly comprising the piezoceramic disc 36 and the metal disc 38 is mounted on a resonating base 40 defining a resonating chamber 42, the base 40, in turn, being fixed inside the housing 24 as will be described hereinafter in greater detail. The piezo alarm is considerably simpler to manufacture than an electromechanical horn. For example, the cost of the piezo alarm is approximately one-half that of an electromechanical horn, and the reliability of the piezo alarm is much greater than the reliability of an electromechanical horn.

The hex inverter HI is comprised of six CMOS gates IC1 through IC6, and the hex inverter not only does the detection but also performs timing and provides an oscillator to operate the piezo alarm PA. While, in the embodiment of the invention illustrated, a hex inverter is utilized having several stages connected in parallel, it will be understood that, in the alternative, three CMOS gates, for example, could also be utilized in place of the hex inverter, or an integrated circuit or other means with sufficient current capability could also be utilized to obtain the same results that are obtained by the hex inverter embodied in the system 10.

The electronic test circuit 13 functions by pulling the junction of the dual photocells V1A and V1B to a firm level established by a lower impedence resistor divider network, as will be described hereinafter in greater detail.

FIG. 1 illustrates a single station system which may be incorporated in a single unitary housing 24. In the operation of the system of FIG. 1, as the circuit proceeds from the normal "ready state" to the smoke triggered alarm condition, ac current flows in at the terminal E1 which is wired to field hot. The ac current goes through the lead 100, then through the line dropping resistor R1, and the lead 101 to enter the full wave bridge B1 comprised of the diodes D1, D2, D3 and D4. Alternating current from the bridge leaves through the terminal E2 to the common field wire of the detector. The full wave bridge output gives full wave rectified current through the lead 102 to the light emitting diode D6 causing the light emitting diode D6 to emit red light. It should be understood that a half wave circuit could also be utilized to supply the light emitting diode D6 and the detector circuit. However, a single diode circuit is more susceptible to voltage transients, provides less stable current and voltage to the detection circuit and requires a higher voltage more costly diode. A portion of the emitted light is also used as a pilot indicator through a clear plastic "light pipe" communicating with the light emitting diode D6 and visible to the users of the smoke detector so that the users will know that the smoke detector has power. The beam portion 18 of the light is directed through the lens 20 provided in the optical sensing head 16 to the smoke sensing chamber 22. Smoke causes light of the beam 18 to deflect onto the sensing half V1A of the dual photocell. The portion 26 of the emitted light is directed onto the "compensating half" V1B of the dual photocell V. The current through the light emitting diode D6 then proceeds through the lead 103 to charge the capacitor C1, and then returns to the diode bridge output through the lead 104. The capacitor C1 provides steady direct voltage from the lead 105 to the lead 104. The Zener diode D5 conducts when the voltage across the capacitor C1 goes higher than 12 volts dc by shunting current from the lead 105 to the lead 104. The Zener diode D5 shunt regulates the entire smoke alarm control system 10 to 12 volts of steady direct current.

The dual photocell V is connected into the circuit as a simple voltage divider. The sensing half, V1A, connects the lead 105 to the node 106 (or pin 1 of the hex inverter). When smoke deflects light from the source light emitting diode D6 onto V1A, the resistance of V1A decreases thereby pulling node 106 toward the 12 volt supply provided by the lead 105. The current into the input of the hex inverter is negligible. The compensation half of the dual photocell, V1B, is not changed by smoke particles. As the voltage between the node 106 and the lead 104 rises above approximately six volts, the hex inverter switches the node 107 (pin 2 of the hex inverter) from the 12 volts provided by the lead 105 to zero volts provided by the lead 104. As the node 107 goes low, the oscillator turns on to sound the alarm. The compensating half, V1B, of the dual photocell performs a balancing effect in the circuit. If ac line voltage rises from the terminal E1 to the terminal E2, more current goes through the light emitting diode D6 and the light emitting diode becomes brighter. Both halves of the dual photocell decrease in resistance thereby cancelling each other. The node voltage at 106 does not change. Similar effects take place with heat, cold, humidity, dark history and the like with the result that everything is balanced out except smoke.

With respect to the oscillator, the node 108 (pin 13 of the hex inverter) has a threshold voltage of approximately six volts. Above six volts, the node 108 is "high" while below six volts the node 108 is "low". If the node 108 is high and inverter logic is considered, then the node 109 is forced low, the node 110 is forced high, and the node 111 is forced low. The opposite chain of events transpires if the node 108 is low.

If no smoke is sensed by the sensing half V1A of the dual photocell, then the node 106 is low and the node 107 is high and is held firmly at 12 volts. With the node 107 higher than the node 108, the oscillator trigger is "clamped" by the forward biased diode D7 to nearly 12 volts and cannot oscillate. When smoke is sensed, the node 106 goes high forcing the node 107 low and the diode D7 is then back biased and exerts no effect on the node 108. with the node 108 now floating, it is open to be pulled or influenced by the resistor R3. The resistor R3 only senses what is on the line 112. In effect, the voltage at the line 112 is transmitted directly to the node 108. At first, the capacitor C3 pulls the line 112 down to zero volts, but as the capacitor C3 charges, the voltage at the line 112 rises because the node 109 is high. As the line 112 rises, the node 108 goes high as does the node 110. Then the capacitor C3 reverses and charges through the resistor R4 and the line 112 goes low again, thereby pulling the node 108 low also. The constant charging and discharging of the capacitor C3 through the resistor R4 provides the basic continual oscillation.

The driver output state is coupled to the piezoceramic material 36 bonded to the metal disc 38. The node 111 connects through the lead 113 to one side S2 of the piezoceramic material. The node 110 is coupled through the lead 114 to the electrode S3 of the piezoceramic material on the opposite side from S2. S2 and S3 are the electrodes that perform the work. The electrodes S2 and S3 are always driven opposite to the other because of the inverter principle, hence the electrode S2 is always 180 degrees out of phase with respect to the electrode S3. The electrode S1 connected to the piezoceramic material is a feedback electrode that pulls the voltage of the lead 112 through the resistor R6. The electrode S1 causes the oscillator to stay on the same inherent resonant frequency as the particular piezo/disc assembly in order to maximize sound output. Any time that the node 108 is free to float the alarm sounds. In the embodiment of the invention illustrated, the piezo alarm PA operates at approximately 3000 cycles per second, and emits more than an 85 decibel alarm level measured at ten feet. The output drivers each comprise two inverters in parallel to allow sufficient current to power the piezoceramic disc assembly to achieve a loud alarm.

Referring to other components of the circuit illustrated in FIG. 1, the resistors R2 and R7 comprise a low impedence divider. Turning the test switch TS causes the normally open contacts E3 and E4 to close. The voltage at the node 106 is now pulled up to 8.25 volts, the same as the voltage at the node 115, and the node 107 goes low, thereby allowing the node 108 to "float" thus turning on the alarm. The capacitor C2 acts as an integrator to prevent the piezo oscillator fluctuation from affecting the node 106. In order to prevent a brief alarm from occurring when line voltage is initially connected to the smoke detector, a timing circuit is provided comprised of the capacitor C4, diodes D8 and D9, and the resistor R8. When the detector is first energized, the capacitor C4 has zero volts across it. The node 116 is therefore at 12 volts above line 104. The node 116 clamps the node 108 through the diode D8 to prevent the oscillator from activating, regardless of the dual photocell input at the node 106. The capacitor C4 charges through the resistor R8 to release the clamp on the node 108 after, for example, approximately two minutes and allows normal operation. If a power outage occurs, the capacitor C4 rapidly discharges through the resistors R2 and R7 and the diode D9 to prevent a nuisance alarm on power restoration. The resistor R5 in the oscillator circuit limits the power to the piezo alarm and protects the hex inverter.

Figure 2:
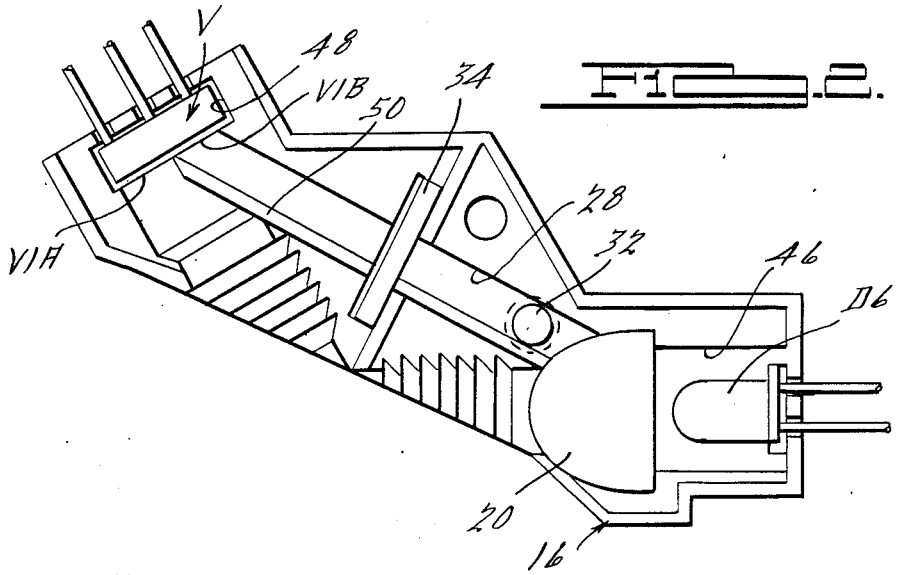
FIG. 2 is an enlarged longitudinal sectional view of a smoke detector head incorporated in the system illustrated in FIG. 1.
Figure 3:
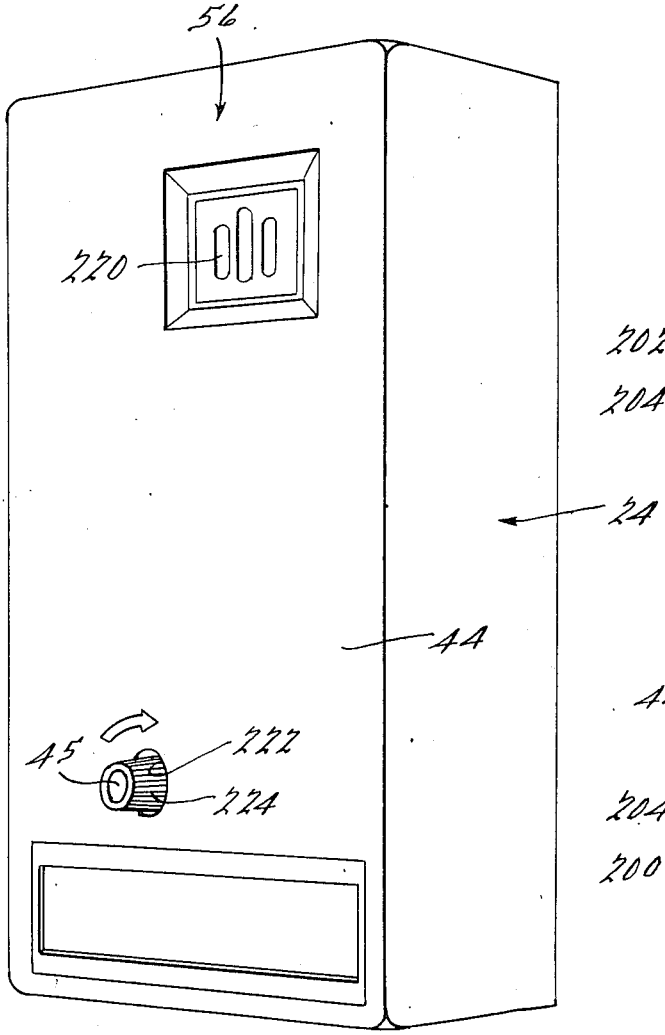
FIG. 3 is a perspective view of a light tight housing utilized to house and support the components of the system illustrated in FIG. 1.
Figure 4:
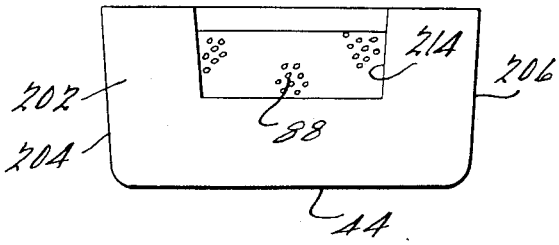
FIG. 4 is a top plan view of the structure illustrated in FIG. 3.
Figure 5:
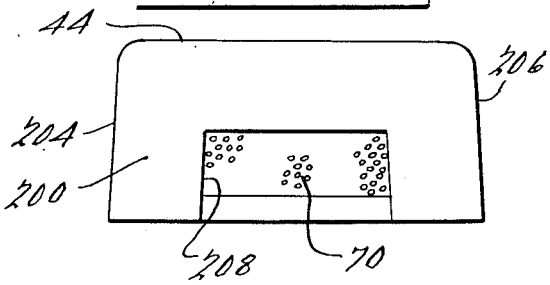
FIG. 5 is a bottom plan view of the structure illustrated in FIG. 3.

As shown in FIG. 2, the light emitting diode D6 is mounted in a longitudinally extending passageway 46 defined by the sensing head 16, the sensing head 16, in turn, being mounted in the housing 24 which is light tight but which permits ambient air to circulate therethrough, whereby any smoke particles present in the ambient air will circulate through the light tight housing 24 as will be described hereinafter in greater detail. The sensing head 16 also defines a chamber 48, and the dual photoelectric cell V is mounted in the chamber 48 so that the active face 15 is in an exposed position. As schematically illustrated in FIG. 7, when there is no smoke (airborne particulate matter) in the ambient air, the light emanating from the light emitting diode D6 is not reflected onto the sensing section V1A of the smoke sensing photoelectric cell V1, it being understood that any "noise" which is appreciably below the normal alarm threshold level light does not affect the operation of the system. The sensing head 16 also defines the tunnel or passageway 28 which communicates with the compensating section V1B of the photoelectric cell V whereby the compensating section V1B is exposed at all times to light emanating from the light emitting diode D6. In the preferred embodiment of the invention illustrated, the optical filter 34 is disposed between the light emitting diode D6 and the compensating section V1B of the dual photoelectric cell. The optical filter 34 may be formed of any desired or suitable optical filter material and serves to reduce the amount of light that is transmitted from the light emitting diode D6 to the compensating section V1B of the photoelectric cell. The sensing head 16 is provided with a longitudinally extending wall 50 which extends between the lens 20 and the dual photoelectric cell V and terminates in line contact with the face 15 of the photoelectric cell V intermediate the sections V1A and V1B to prevent ingress of smoke particles into the tunnel or passageway 28.

The lens 20 serves to focus the light emanating from the light emitting diode into the relatively narrow beam 18, as schematically illustrated in FIG. 7, which beam normally is not reflected onto the section V1A of the dual photoelectric cell when smoke is not present in the ambient atmosphere.

The sensing head 16 and all of the aforementioned electrical components with the exception of the piezo alarm PA are preferably mounted on a circuit board 52, the circuit board 52 in turn being mounted in the housing 24. As previously mentioned, the housing 24 is light tight but permits ambient air to circulate therethrough whereby any smoke particles present in the ambient air will circulate through the light beam 18 emanating from the light emitting diode D6. The piezo alarm PA is also mounted in the housing 24 in a manner which will be described hereinafter in greater detail whereby sounds emanating from the piezo alarm may be readily heard by any persons in the vicinity.

Referring to FIGS. 3 through 8, the housing 24 is utilized to house and support the aforementioned components of the system 10, the housing 24 being comprised of a base, generally designated 54, and a cover, generally designated 56, the base and the cover preferably being formed of plastic or other suitable material having sufficient strength and physical properties fit and sufficient for the purpose intended. As shown in the drawings, the base includes a substantially flat back wall 58 and integral end walls 60 and 62 joined by integral side walls 64 and 66. The end wall 60 defines a centrally disposed inlet air opening 68, and a generally rectangular filter 70 is provided which overlies the inlet opening 68, the filter 70 preferably being formed of open cell plastic material having interstices of a size which will trap dust and dirt but which permit air and smoke to pass therethrough. The filter 70 is retained by inwardly projecting flanges 72 and 74 and by interior upstanding baffles, such as 76, 77, 78 and 80, the baffles 76, 77, 78 and 80, in turn, being formed integrally with the base whereby air and any smoke contained therein is permitted to enter the housing after such air has passed through the filter 70. The circuit board 52 is mounted in the light tight chamber 22 defined by the housing 24 and the interior baffles thereof. The side walls 64 and 66 also cooperate with the interior walls and baffles as illustrated in FIG. 6 to define a chamber 84 in which the piezoceramic alarm PA is mounted.

The end wall 62 of the base defines a centrally disposed outlet air opening 86 behind which is mounted a generally rectangular filter 88 which is preferably formed of the same material as the filter 70 and which functions to trap dust and dirt present in the ambient atmosphere while permitting air and smoke to pass therethrough. The filter 88 is retained by generally L-shaped flanges 90 and 92 and an upstanding finger 94 defining outlet openings 96 and 98 therebetween. The cover 56 includes the generally flat front wall 44 and integral end walls 200 and 202 joined by integral sidewalls 204 and 206, the end and side walls of the cover overlying the end and side walls of the base when the housing 24 is assembled. The end wall 200 of the cover defines an inlet air opening 208 aligned with the filter 70 and the inlet opening 68 in the base. The cover 56 also includes interiorly projecting baffles which cooperate with the interior baffles and walls of the base to define the chambers 22 and 84, and the end wall 202 of the cover defines an outlet opening 214 aligned with the filter 88 at the outlet air opening 86 in the base whereby the cover and the base cooperate to define a tortuous air passageway through the housing 24 which permits ambient air and any smoke contained therein to flow through the housing, the heat generated by the electrical components of the system 10 enhancing the chimney effect provided by the housing and insuring a continuos flow of air and any smoke contained therein through the housing.

In the preferred embodiment of the invention illustrated, the front wall 44 is provided with recessed openings such as 220 which overlie the piezoceramic alarm PA whereby any sound emanating from the piezo alarm may be readily heard by persons in the vicinity. The front wall 44 of the cover is also provided with a circular opening 222 through which a tubular actuating knob 224 for the switch TS projects, the actuating knob 224 in turn surrounding the light pipe 45 which is formed of a clear plastic tubular rod and which communicates with the light emitted by the light emitting diode D6 and is visible to the users of the smoke detector so that the users will know that the smoke detector has power.

Figure 11:
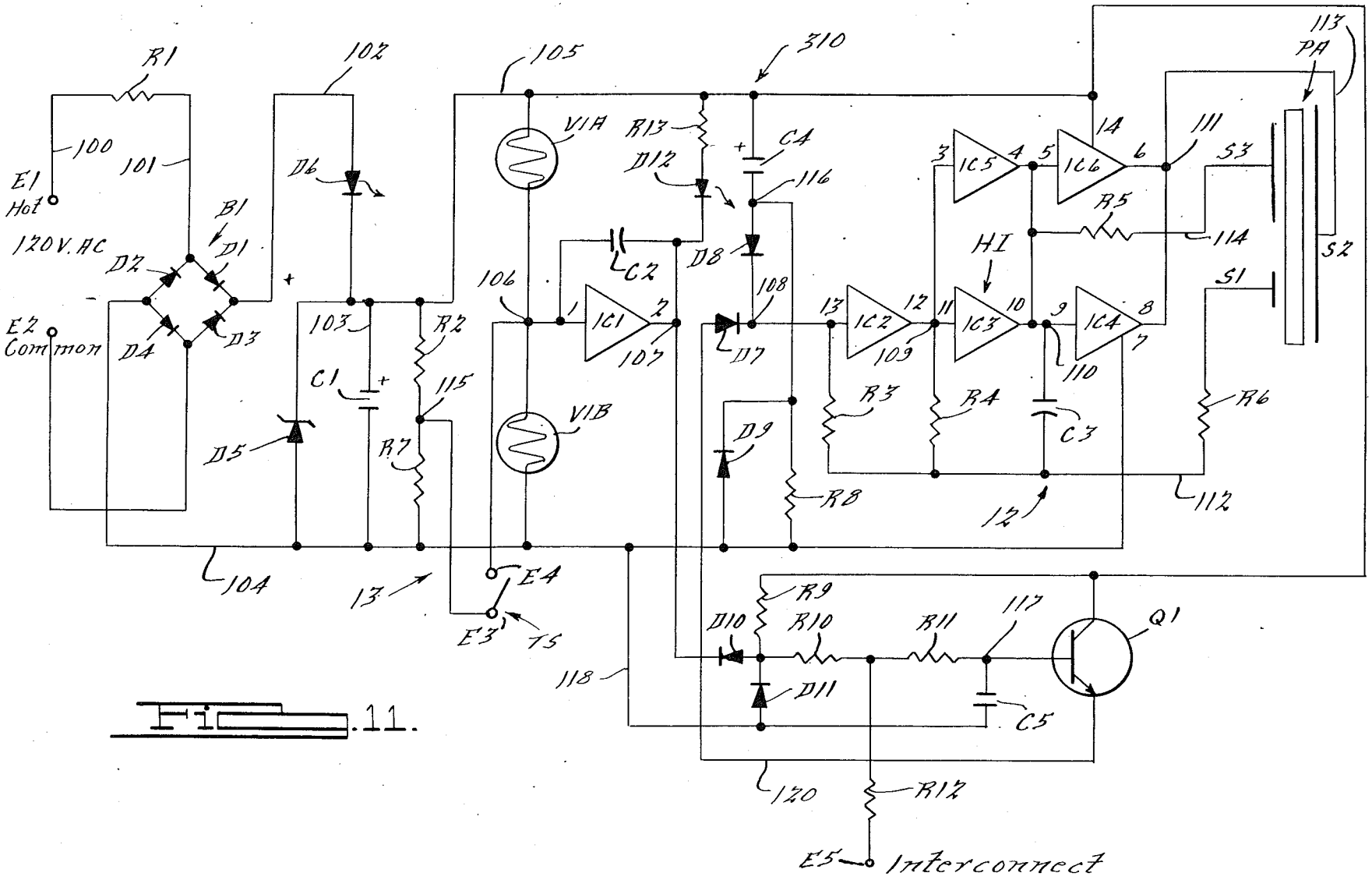
FIG. 11 is a schematic electrical circuit diagram of a smoke detector system and illustrating another embodiment of the present invention.

Another embodiment of the invention is illustrated in FIG. 11 and is comprised of a photoelectric smoke detector and alarm system, generally designated 310, which may be mounted in the housing 24 in the manner previously described. The system 310 allows up to thirty detectors to be wired into one system, and if any one detector senses smoke, all of the alarms of all of the detectors will be energized. It will be appreciated that in large homes or commercial buildings, the detector that first senses smoke may be too far away to be heard by an endangered occupant. The embodiment of the invention illustrated in FIG. 11 enables any single station detector to be quickly transformed into a multi-station detector in the factory by the installation of a small number of components into the circuit illustrated in FIG. 1, an insulated wire also being connected and run to the outside of the detector as the interconnect wire. The embodiment of the invention illustrated in FIG. 11 includes all of the components of the system illustrated in FIG. 1, and such components operate in the manner previously described. In addition, the embodiment of the invention illustrated in FIG. 11 includes diodes D10 and D11, a light emitting diode D12, resistors R9, R10, R11, R12 and R13, a capacitor C5 and a transistor Q1.

When a group of detectors are wired in tandem, it is important to locate the one detector that is responsible for initiating all of the alarms. In the embodiment of the invention illustrated in FIG. 11, the unit causing the alarm will have a light emitting diode D12 lighted while all of the rest of the detectors in the system will not. Such a construction is useful either for determining the area where the fire is starting, or for finding a faulty detector emitting a nuisance alarm and as a result thereof has turned on all of the detectors in the multiple unit system. In this embodiment of the invention, suitable provision is made in the cover of the housing in the form of an opening whereby light emanating from the diode D12 is readily visible to users of the system to indicate that that particular unit has triggered an alarm which has energized all of the smoke detectors in the system.

In the operation of the embodiment of the invention illustrated in FIG. 11, in the normal no-smoke condition, the node 107 is at 12 volts (high), and the diode D10 is back biased so that no current flows. However, current does flow through the supply wire 105 and through the resistors R9, R10 and R11 to charge the capacitor C5. The current then continues through the line 118 to the zero volt line 104. In steady operation, the capacitor C5 is charged to well over six volts and the transistor Q1 clamps the node 108 through the forward biased diode D7. Since the transistor Q1 clamps the node 108 above six volts, the oscillator is off.

When smoke is sensed, the node 107 is driven to zero volts (low) and the diode D10 is forward biased. Current is now dumped out of the capacitor C5 through the resistors R10 and R11 thereby making the node 117 very low in voltage and near the voltage of the line 104. The transistor Q1 then ceases to be "on" and the diode D7 is back biased to release the node 108. The piezo alarm PA then sounds. The interconnect wire E5 is then forced to a lower voltage through the resistor R12, the resistor R10 and the diode D10. The interconnect wire E5 is connected to other interconnect wires from other identical detectors. The trigger detector through E5 causes all other capacitors C5 in the other detectors to discharge. All of the transistors Q1 in all of the non-smoke triggered detectors stop conducting through the line 120. All of the node 108 junction points at each non-triggered detector become unclamped, and all of the alarm oscillators in each non-smoke triggered detector turn on to sound the "slave" alarms.

When the entire interconnected system is first energized, the capacitor C4 acts in its timer role to clamp all of the node 108 junctures. Since the node 107 is high (no smoke), the capacitor C5 charges through the resistors R9, R10 and R11. After, for example, approximately ten seconds, the capacitor C5 has accumulated enough charge so that the node 117 is more than six volts. The transistor Q1 then begins to clamp the node 108 through the diode D7 thereby taking over the role of the capacitor C4 as the capacitor C4 times out of its clamping function. Consequently, the piezo alarms never sound in the entire system due to the initiation of energizing power.

It will be appreciated that when smoke is detected or sensed by a particular detector in the system and the node 107 is driven to zero volts, the light emitting diode D12 in the detector which has sensed smoke will be lighted while the light emitting diode D12 in all of the rest of the detectors in the system will not be lighted thereby enabling the users of the system to determine the area where the fire is starting, or enabling such users of the system to find a fulty detector that is sounding a nuisance alarm. It will also be appreciated that the embodiment of the invention illustrated in FIG. 11 enables both sending and receiving functions to be performed while only requiring the addition of one wiring terminal to the system illustrated in FIG. 1.

Typical values for the components of the systems 10 and 310 described hereinabove are as follows:

D1 Signal Diode 1N4148
D2 Signal Diode 1N4148
D3 Signal Diode 1N4148
D4 Signal Diode 1N4148
D5 Zener Diode 1N5242
D6 Gallium Aluminum Arsenide Light Emitting Diode
D7 Signal Diode 1N4148
D8 Signal Diode 1N4148
D9 Signal Diode 1N4148
D10 Signal Diode 1N4148
D11 Signal Diode 1N4148
D12 Light Emitting Diode
C1 Aluminum Electrolytic Capacitor 470 mfd+50%, −10% 16 V Radial Lead
C2 Capacitor, 0.001 mfd±20% 50 V Axial Lead
C3 Capacitor, 0.0022 mfd±20% 50 V Axial Lead
C4 Aluminum Electrolytic Capacitor 100 mfd+50%, ±20%, Low Leakage, 16 V
C5 Capacitor, 0.1 mfd, ±20% 50 V Axial Lead
Q1 NPN Signal Transistor 2N3904 Collector Current-200 milliamps, HFE-40 MIN.
R1 Wire Wound Resistor, 4.5 K ohms, 5 W±10% for 120 volt model or Carbon Resistor, 430 ohms, 1 W±10% for 24 volt ac or dc model
R2 Carbon Composition or Film, 6.8 K ohms, ¼ W±10%
R3 Carbon Composition or Film, 1 Meg ohms, ¼ W±10%
R4 Carbon Composition or Film, 270 K ohms, ¼ W±10%
R5 Carbon Composition or Film, 270 ohms, ¼ W±10%
R6 Carbon Composition or Film, 56 K ohms, ¼ W±10%
R7 Carbon Composition or Film, 15 K ohms, ¼ W±10%
R8 Carbon Composition or Film, 5.6 Meg ohms, ¼ W±10%
R9 Carbon Composition or Film, 4.7 Meg ohms, ¼ W±10%
R10 Carbon Composition or Film, 22 K ohms, ¼ W±10%
R11 Carbon Composition or Film, 100 K ohms, ¼ W±10%
R12 Carbon Composition or Film, 47 K ohms, ¼ W±10%
R13 Carbon Composition or Film, 3.3 K ohms, ¼ W±10%
V1A& V1B Dual Photocell Formed on One Substrate
HI Hex Inverter Integrated Circuit, Motorola MC14069UB
Piezo Electric Ceramic Transducer NTK EC-F250-355-B It will be understood, however, that these values may be varied depending upon the particular application of the principles of the present invention. For example, the value of the resistor R1 may be adjusted as indicated in the above table so that the systems will operate on other voltages, such as 24 volts ac, and it will be understood that the systems also operate on direct current voltages comparable to the alternating current voltages for which the systems are designed.

While preferred embodiments of the invention have been illustrated and described, it will be understood that various changes and modifications may be made without departing from the spirit of the invention.

What is claimed is:

1. In a smoke detector and alarm system, the combination including housing means defining a light tight interior chamber, said housing means having an inlet opening and an outlet opening each communicating with said interior chamber, means in said housing means including a plurality of baffles defining a tortuous passageway preventing the passage of ambient light into said interior chamber while permitting air and airborne particulate matter contained therein to flow into said interior chamber from said inlet opening and out of said interior chamber through said outlet opening, piezoceramic electrically activatable alarm means carried by said housing means, an illuminating circuit including a gallium aluminum arsenide light emitting diode mounted in said interior chamber, means providing a direct current supply for said light emitting diode, a smoke sensing circuit including dual photoelectric means formed on the same substrate and the electrical conductivity of each of which varies as a function of the amount of light impinging thereon, said dual photoelectric means being connected in series and being electrically connected to said means providing a direct current supply for said light emitting diode, means mounting said dual photoelectric means in said interior chamber in proximity to said light emitting diode whereby light emanating from said light emitting diode impinges upon one of said dual photoelectric means at all times and impinges upon the other of said dual photoelectric means to change the conductivity of said dual photoelectric means when airborne particulate matter is present in said interior chamber, and means activatable in response to a differential in the conductivity of said dual photoelectric means for activating said piezoceramic alarm means.

2. The combination as set forth in claim 1 including timing means effective to delay the activation of said piezoceramic alarm means for a predetermined period of time.

3. The combination as set forth in claim 2 including test switch means electrically connected to the junction of said dual photoelectric means and manually actuatable exteriorly of said housing means.

4. The combination as set forth in claim 3 including adjustable screw means disposed within said housing and effective to vary the amount of light impinging on said one dual photoelectric means.

* * * * *